United States Patent [19]

Kurihara et al.

[11] Patent Number: 4,457,230

[45] Date of Patent: Jul. 3, 1984

[54] TYPEFONT WHEEL AND BELT FOR SMALL PRINTER

[75] Inventors: Hitoshi Kurihara, Chichibu, Toru Wakazawa, Yokoze, both of Japan

[73] Assignees: Canon Kabushiki Kaisha, Tokyo, Canon Denshi Kabushiki Kaisha, Saitama, both of Japan.

[21] Appl. No.: 328,186

[22] Filed: Dec. 7, 1981

[30] Foreign Application Priority Data

| | | | |
|---|---|---|---|
| Dec. 12, 1980 | [JP] | Japan | 55-175980 |
| Jan. 9, 1981 | [JP] | Japan | 56-1847 |
| Jan. 12, 1981 | [JP] | Japan | 56-2871 |
| Jan. 12, 1981 | [JP] | Japan | 56-2872 |
| Jan. 12, 1981 | [JP] | Japan | 56-2873 |
| Jan. 13, 1981 | [JP] | Japan | 56-3576 |
| Jan. 13, 1981 | [JP] | Japan | 56-3577 |
| Jan. 13, 1981 | [JP] | Japan | 56-3578 |

[51] Int. Cl.[3] ..... B41J 1/32

[52] U.S. Cl. ..... 101/110; 101/111

[58] Field of Search ..... 101/93.13, 93.14, 93.21, 101/93.26, 415.1, 378, 111, 99, 110, 146, 109

[56] References Cited

U.S. PATENT DOCUMENTS

| | | | |
|---|---|---|---|
| 3,717,234 | 2/1973 | Koller | 101/109 X |
| 4,013,005 | 3/1977 | Keefe | 101/110 |
| 4,050,376 | 9/1977 | Keefe | 101/111 |
| 4,095,686 | 6/1978 | Okabe | 101/95 X |
| 4,263,242 | 4/1981 | Jenkins | 101/111 X |
| 4,337,698 | 7/1982 | Jenkins | 101/111 |

*Primary Examiner*—Edward M. Coven

*Attorney, Agent, or Firm*—Fitzpatrick, Cella, Harper & Scinto

[57] ABSTRACT

This invention relates to a typefont belt and a typefont wheel for use in the small printer. The typefont belt made, for example of rubber, is fitted around a cylindrical support to compose the typefont wheel and is struck by a printing hammer provided in the support to perform printing on the printing sheet.

11 Claims, 22 Drawing Figures

TYPEFONT WHEEL AND BELT FOR SMALL PRINTER

BACKGROUND OF THE INVENTION

1. Field of the Invention

The present invention relates to a typefont wheel and a typefont belt for use in a small printer in which the typefont belt made, for example, of rubber and fitted around a cylindrical support to compose a typefont wheel, is struck by a printing hammer provided inside said support to perform printing on a printing sheet.

2. Description of the Prior Art

In a conventional small printer employing a typefont wheel wherein a typefont belt for example, of rubber and fitted around a cylindrical support member is struck by a printing hammer provided in said support member, to perform printing, the typefont wheel and the typefont belt have various drawbacks.

Some of the drawbacks are related to the service life. For example, the typefont belt fitted on the support member is often disengaged from the support member. Also, the ink may extrude from the partially disengaged portion.

The conventional typefont wheel for small printer is composed of a typefont belt 1 as shown in FIG. 1 fitted around a cylindrical or roller-shaped support member 2 as shown in FIG. 2 (hereinafter referred to cylindrical support member). As shown in FIG. 1, the belt 1 is provided on the surface thereof with type portions 1*a* and type base portions 1*b* positioned thereunder, and further with corresponding pin portions 1*c* extending downwards to be fitted in plural holes 2*a* provided on the support member 2 shown in FIG. 2. Also under the blank type portions 1*f* there are provided connecting pins 1*e* which are bonded with an adhesive material to connecting recesses 1*g*. Similarly a belt portion 1*d* is bonded with an adhesive material to a belt portion 1*h*. Said blank type portions 1*f* are provided as timing spaces for the paper advancing function. Inside said typefont wheel there is provided a printing hammer H as shown in FIG. 4,A printing sheet and a platen are positioned in facing relationship to the type portions 1*a* on which printing ink is applied by an ink roller 5 shown in FIG. 3.

In the above-explained structure, the typefont wheel is rotated by a motor (not shown) to a position where a pin 1*c* is positioned in front of the hammer H, and the hammer H is driven towards the left to strike said pin 1*c*, thereby bringing the type portion 1*a* into contact with the printing sheet to perform printing thereon. In such a system, in fitting the typefont belt 1 around the cylindrical support member 2 and bonding the edge of said belt, the connecting recesses 1*g* at an end of the typefont belt 1 are at first inserted into the holes 2*a* of the support member 2 as shown in FIG. 3, and the connecting pins 13 at the other end of the belt 1 are fitted thereon with an adhesive material 4 therebetween.

The adhesion is, preferably, completed within several seconds to several minutes, but a longer adhesion time is required for example in case of bonding the typefont belt 1 made of silicone rubber with a silicone adhesive material. For this reason, one has to hold the bonded portion for a time and use complicated jigs in order to obtain complete adhesion. In case of incomplete adhesion, the belt portion 1*d* becomes separated from the belt portion 1*h* to form a gap as shown in FIG. 3 due to the limited adhering area. If the ink roller 5 is maintained in contact while the typefont wheel is at a standstill or is rotated, the ink intrudes into the gap between the belt portions 1*d* and 1*f*, and eventually into the space between the typefont belt 1 and the support member 2. introduced ink causes sticking or adhesion between the typefont belt 1 and the support member 2 which is extremely detrimental to the function of the printing hammer positioned inside the typefont wheel, since the printing energy has to be significantly increased in order to avoid unsatisfactory printing such as totally or partially lacking characters.

Also such a conventional structure as explained above, has manufacturing drawbacks. In such a structure, the cylindrical support member 2 is inevitably expensive as it is provided with a plurality of radially oriented holes 2*a* which have to be formed with drills or presses and by time-consuming operations.

Furthermore, such a conventional structure has drawbacks in the printing quality.

As shown in FIG. 4, the typefont wheel 7 is rotated by an unrepresented control device and is stopped at a position where the pin portion 1*c* of a selected character or symbol faces the hammer H, which is then driven towards the left to print said character or symbol on the printing sheet 9 positioned on the platen 8. In order to improve the printing efficiency, the typefont belt is usually made of an elastic material having a high degree of softness, such as A30° C. to A50° C., in the hardness range. Such a typefont belt, however, tends to cause a smear on the printing sheet in certain characters or symbols having small type areas such as "-" or "." because of the contact of the shoulder 16*b* of the type base with the printing sheet when the type is driven into contact with the platen 8 by the hammer H. Such a smear deteriorates the printing quality and significantly reduces the efficiency of the printer itself.

On the other hand, a harder rubber, if employed for the typefont wheel in order to prevent such a smear, may result in partly lacking print due to deficient printing pressure in types with large areas, such as "0" or "8"

SUMMARY OF THE INVENTION

The object of the present invention is to provide a typefont wheel and a typefont belt therefor having excellent performance in various aspects.

Another object of the present invention is to provide a typefont wheel and a typefont belt therefor with improved durability.

Still another object of the present invention is to provide a typefont wheel and a typefont belt which permits improved efficiency in its manufacture.

Still another object of the present invention is to provide a typefont wheel and a typefont belt capable of providing improved print quality.

Still other objects of the present invention will be made apparent from the following description of the preferred embodiments.

DETAILED DESCRIPTION OF THE PREFERRED EMBODIMENTS

Figure 5:
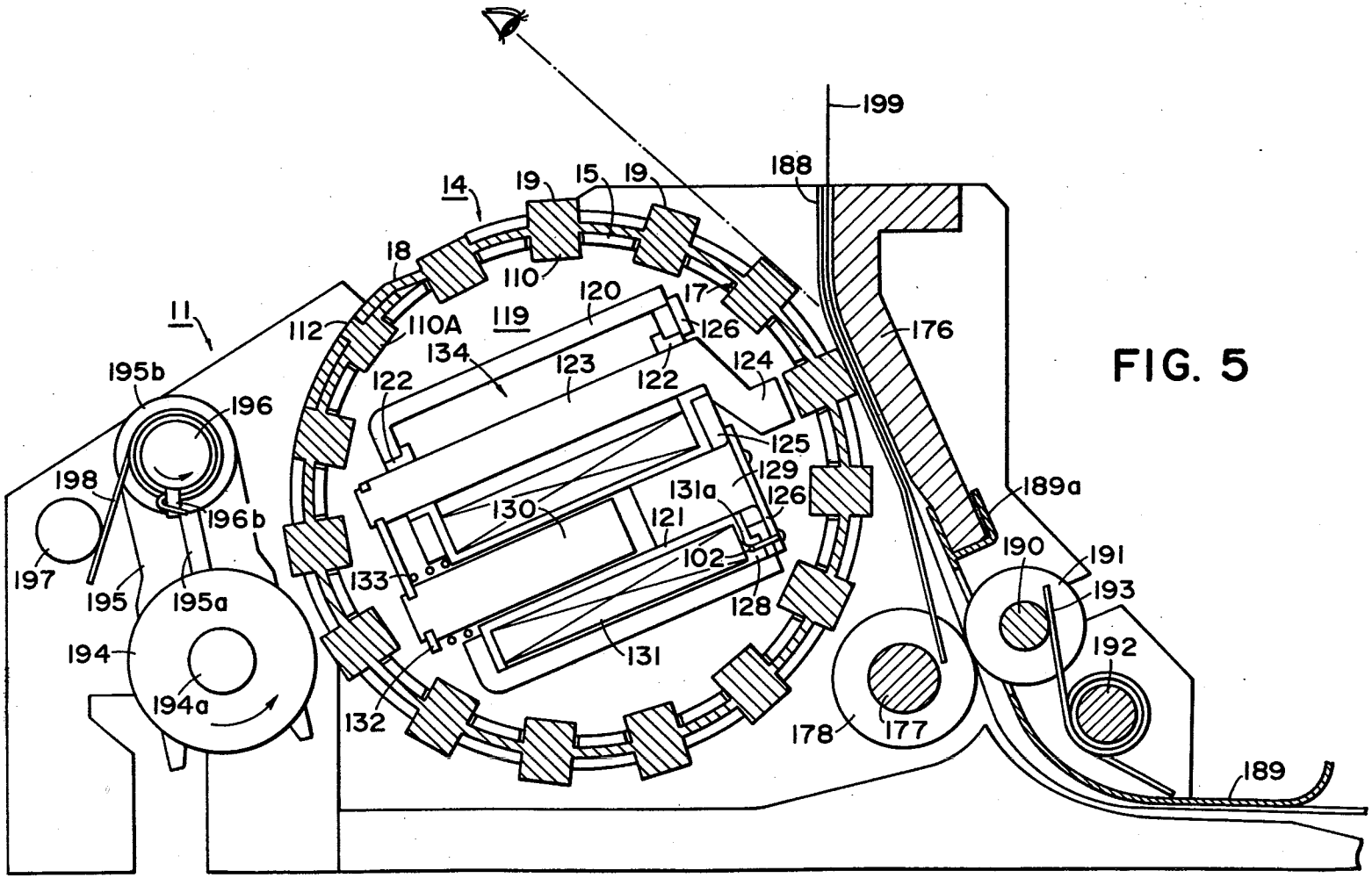
FIG. 5 is a cross-sectional view of a small printer applicable to and embodying the present invention.

At first reference is made to FIG. 5 showing, in a cross-sectional view, the principle portion of a small printer adapted for applying the following embodiments and capable of improving the durability of the typefont wheel, wherein a main frame 11 made, for example, of a plastic material rotatably supports a typefont wheel 14. Said typefont wheel 14 is assembled on a cylindrical support member 15 having holes 17 at a determined pitch and with a staggered or checkerboard arrangement. A typefont belt 18 made of a macromolecular rubber, such as ethylene-propylene rubber, fluorinated rubber, neoprene rubber, acrylic rubber, chloroprene rubber, chlorosulfonated polyethylene, strenebutadiene rubber, urethane rubber, NBR or silicone rubber, or a synthetic macromolecular resin, such as polyurethane, is formed as a ring or a belt and is fitted annularly around the support member 15.

Said typefont belt 18 is provided on the top face thereof with protruding types 19, and is further provided, on the bottom face thereof, with corresponding protruding pins 110 which are slidably fitted in the holes 17 of the support member 15. Consequently, the types 19 on the typefont belt 18 are also arranged in the staggered or checkerboard fashion. The pitch of the pins 110 of the typefont belt 18 is made slightly smaller than that of the holes 17, so that said belt 18 is fitted in a slightly extended state. In this manner, the typefont belt 18 is stably mounted on the support member 15 and ensures rapid and smooth returning movement after it is outwardly extended for printing.

Figure 6:
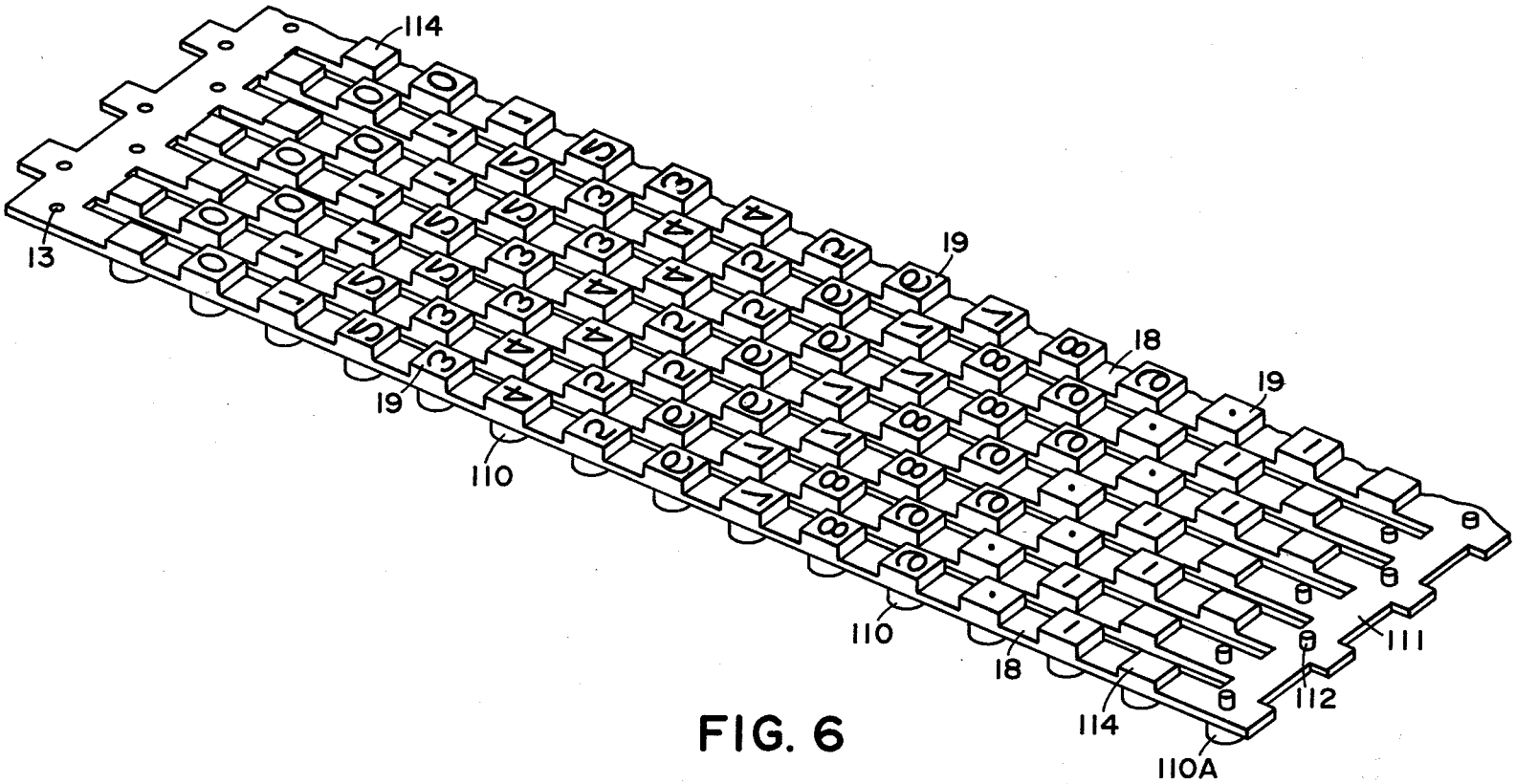
FIG. 6 is a perspective view of the typefont belt employed in the printer shown in FIG. 5.
Figure 7:
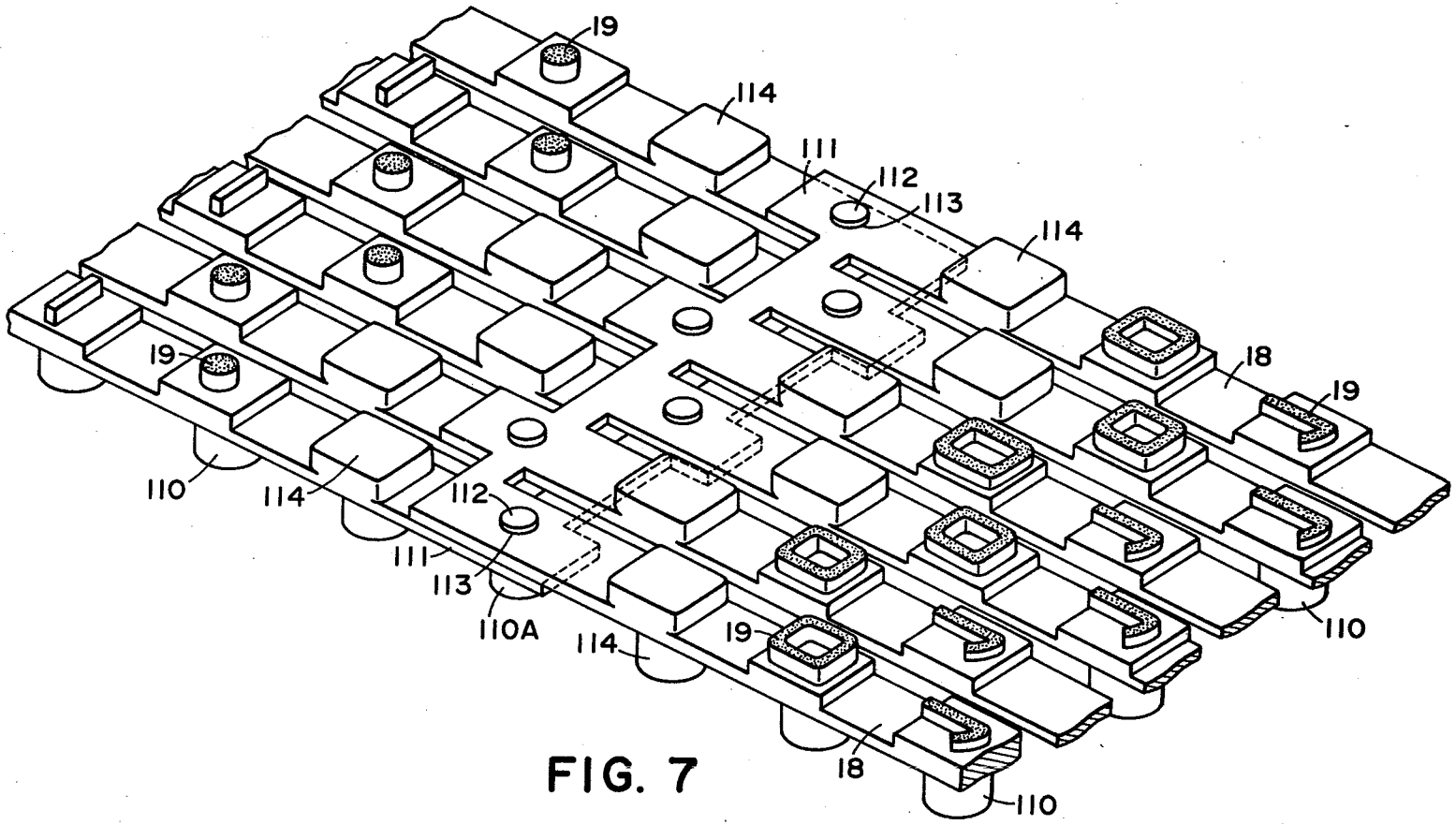
FIG. 7 is a partial perspective view of the bonding portion of the typefont belt shown in FIG. 6.

The typefont belt 18 of the above-explained structure can be composed of parallel independent stripes, or formed as an integral unit having, as shown in FIGS. 6 and 7, planar portions 111 connecting both ends of plural typefont strips. One of said planar portions 111 is provided with short cylindrical pins 112 in a staggered arrangement, while the other of said planar portions 111 is provided with holes 113 for engaging with said pins 112. Thus the typefont belt can be connected in annular form by mutually superposing said planar portions 111, 111 and fitting the pins 112 with the holes 113 after said typefont belt is fitted around said support member 15.

Said planar portions 111 are positioned to correspond to a so-called blank or dummy type area having no printing types and are utilized for the advancement of the printing sheet through mechanical sequence. In the illustrated embodiment, the typefont belt is provided, in said dummy type area, with dummy types 114 of a height the same as or slightly smaller than that of the normal types. Also, the aforementioned pins 112 are of a height the same as or slightly smaller than that of the normal types 19.

The height of the dummy types is selected in the above-mentioned manner in order to reduce the swinging motion of the ink roller, thereby avoiding excessive ink deposition on the types when the ink roller moves from the dummy type area to the neighboring types. A smaller height of the dummy types is preferred to prevent smearing on the printing sheet since the height in the bonding portion of the typefont belt may be increased by the use of an adhesive material. Also the presence of burrs is unavoidable in the injection molding of the typefont belt, but a smaller or lower height of the dummy types will prevent the burrs present in this area from contacting the printing sheet. Thus, the production yield of typefont belts will improve.

A hammer assembly 119 is positioned inside the typefont wheel which is structured as explained in the foregoing. Said hammer assembly 119 is assembled on a U-sectioned yoke 120, in which there is aligned a plurality of bobbins 121. In the upper bosses 122 of said bobbins 121 there is slidably fitted is a hammer 123, of which an end has an S-shaped structure as which illustrated constitutes a striking head 124 positioned in facing relationship to the internal periphery of the support member 15. Said striking head 124 is positioned to correspond to two adjacent typefont strips 18, 18. In this manner a striking head 124 strikes two adjacent typefont strips. However, said striking head prints only one character at each motion since the pins 110 are arranged in a staggered fashion in the mutually adjacent typefont strips. Such a hammer structure permits use of a plunger for every two typefont strips, thus saving space and permitting a compact construction. In front of the bobbins 121 this is fitted a front board 125 on which a printed circuit board 126 is provided. A lead wire 131*a* of the coil 131 is soldered to a pin 102 fixed on a boss 128 which penetrates through the bobbin 121, thereby making connection to said printed circuit board 126. A fixed iron core 129 caulked on and penetrating through the front board 125 is inserted by a determined length into the bobbin 121, and a movable iron core 130 is slidably fitted in the bobbin 121 in facing relationship to said fixed iron core 129. The coil 131 is wound around said iron cores 129, 130. The outer end of said movable iron core 130 is connected to the outer end of the hammer 123 through a bracket 132 supporting a coil spring 133 against an end face of the bobbin 121. In order to reduce the introductory time at the start of energization, the hammer 123 is made of a material of light mass, such as aluminum or a hard plastic material. A plunger 134 is composed of the above-mentioned members, so that the hammer 123 is separated from the typefont belt in the normal state by the coil spring 133 but is activated for printing when the movable iron core 130 is attracted by the energized coil 131.

A shaft 177, having a rubber roller 178 for advancing the printing sheet fixed thereon, is rotatably supported parallel to the aforementioned typefont wheel 14 and at the side of a platen 176 constituting the front wall of the frame 11.

Also, opposite to the rubber roller 178 across said typefont wheel 14, there is provided an ink roller 194 having shaft 194*a* which is supported by swinging levers 195. Said swinging levers 195 are provided in the center thereof with longitudinal grooves 195*a* which elastically support shaft 194*a*. Said swinging levers 195 are provided on the upper ends thereof with cylindrical portions 195*b* for supporting a shaft 196, of which both ends 196*a* are rotatably supported in holes 12*c* provided in side plates 12. Another shaft 197 is supported in holes 12*d* in said side plates 12, and is parallel to said shaft 196 and ink roller 194. On said shaft 196 there is provided a torsion spring 198 of which an end engages with a pin 196*b* positioned on said shaft 196 and another end engages with the shaft 197 to bias the ink roller 194 toward the typefont wheel 14. The printing sheet is indicated by 199.

The above-explained embodiment functions in the following manner.

Prior to the start of printing operation, the typefont wheel 14 is rotated, stepwise, a determined angle in a clockwise direction shown in FIG. 5. Then, in response to an instruction from a control circuit (not represented) for printing a specified character, the typefont wheel 14 is stopped at a determined position for printing, and the coil 131 of a selected plunger is energized to attract the movable iron core 130 against the function of the coil spring 133. Thus, the hammer 123 is advanced to strike a pin 110 of the selected typefont strip 18 by the striking head 124, whereby the elastic typefont belt 18 is extended to press the printing sheet 199 against the platan 176, thereby performing the printing operation.

Upon completion of the printing operation in this manner, the shaft 177 is rotated to rotate the rubber roller 178 counterclockwise, thus advancing the printing sheet 199 by a determined length in cooperation with a pinch roller 191.

The pins 110A corresponding to protruding portions 112 at the bonding portion of the typefont belt are formed shorter than other pins 110 in order to prevent disengagement of said bonding portion which would result from an unexpected striking of said pins 110A by the striking head 124 of the hammer 123.

In the following is another embodiment which is capable of ensuring firm fitting of the typefont belt and improving the durability of the typefont wheel.

Figure 8:
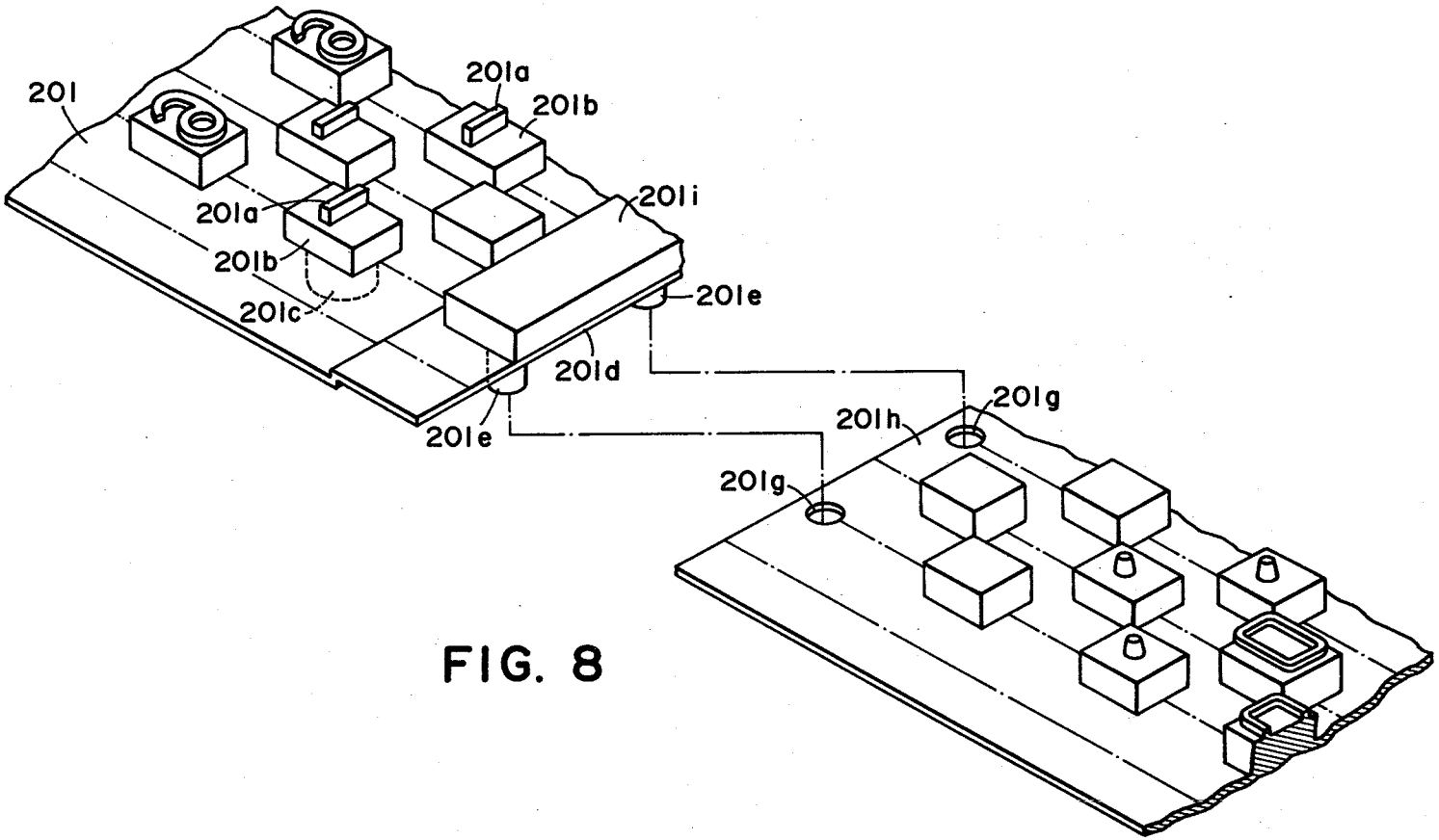
FIG. 8 is a schematic view of another embodiment of the typefont belt.
Figure 9:
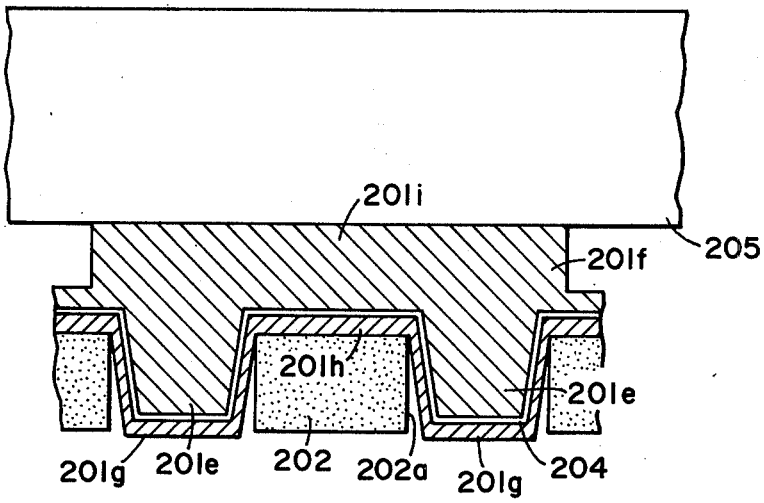
FIG. 9 is a schematic view showing the bonding portion of the typefont belt shown in FIG. 8.

FIG. 8 shows a typefont belt 201 embodying the present invention in a perspective view and, FIG. 9 shows the mutually bonded end portions of said typefont belt in a cross-sectional view, wherein there is shown type portions 201*a*, type base portions 201*b* and corresponding pins 201*c*.

As shown in FIG. 8, the dummy type on the typefont belt 201 is extended on the belt portion to constitute an oblong member 201*i*, under which bonding pins 201*e* are provided at a determined pitch for engaging with bonding recesses 201*g* provided at the other end of the typefont belt. As shown in FIG. 9, said bonding recesses 201*g* and the surrounding belt portion 201*h* are bonded, by means of an adhesive material 204, to the bonding pins 201*e* and the surrounding belt portion 201*d*. The dummy type 201*i*, being extended over the belt portion 201*d*, provides a flat upper face which serves for bonding the belt end portions by simply pressing with a flat tool. Also the above-explained structure provides a uniform pressure distribution at the bonding and avoids the formation of a gap between the belt portions 201*d* and 201*h*, thus preventing ink from the ink roller 205 from entering into said gap. In FIG. 9, the support member and the holes provided therein are indicated by 202 and 202*a*, respectively.

As explained in the foregoing, the typefont wheel of the above-mentioned embodiment not only improves the manufacturing efficiency but also prevents the trouble of ink intrusion or entrance and reduces the energy required for printing.

In the following is another embodiment capable of facilitating manufacturing procedures.

Figure 10:
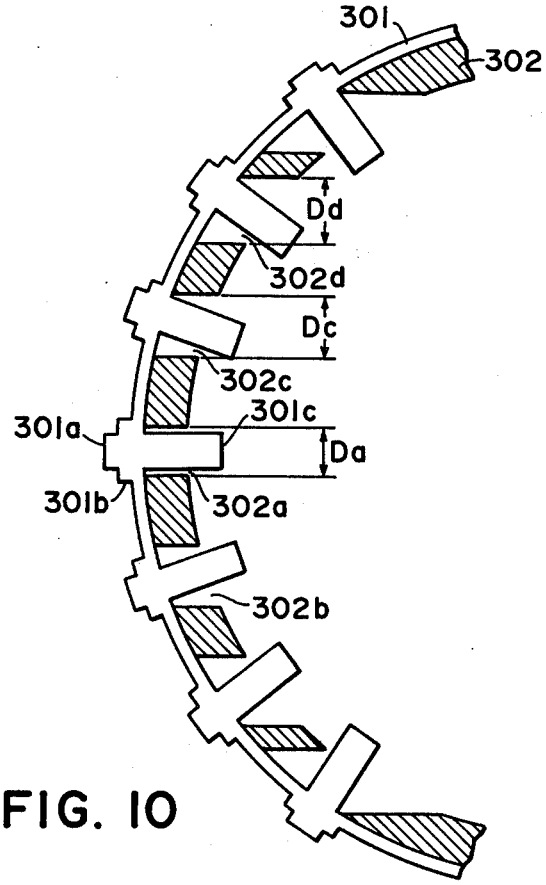
FIG. 10 is a cross-sectional view showing still another embodiment of the typefont wheel.

FIG. 10 shows an embodiment of the support member 302 which has fitted thereon typefont belt 301 having type portions 301*a*, type base portions 301*b* and pin portions 301*c*.

The support member 302 is provided with a plurality of holes some of which, for example a hole 302*a*, is directed towards the center of the support member 302 while most of the other holes, such as 302*b*, 302*c*, 302*d* etc., are formed with a center line parallel to that of the above-mentioned hole 302*a*. In addition the hole 302*a* has an internal diameter which is the same as that of the plurality of holes 2*a* shown in FIG. 2, but the neighboring holes 302*c*, 302*d*, etc., have a larger internal diameter in order to have a same diameter when viewed from the center of the support member 302. More specifically, the diameters Da, Dc and Dd of the holes 302*a*, 302*c* and 302*d*, respectively, satisfy a relation $Da<Dc<Dd$. Such a structure allows easy molding of the support member, for example with a plastic material.

In the following there is shown another embodiment allowing improved manufacturing efficiency.

Figure 11:
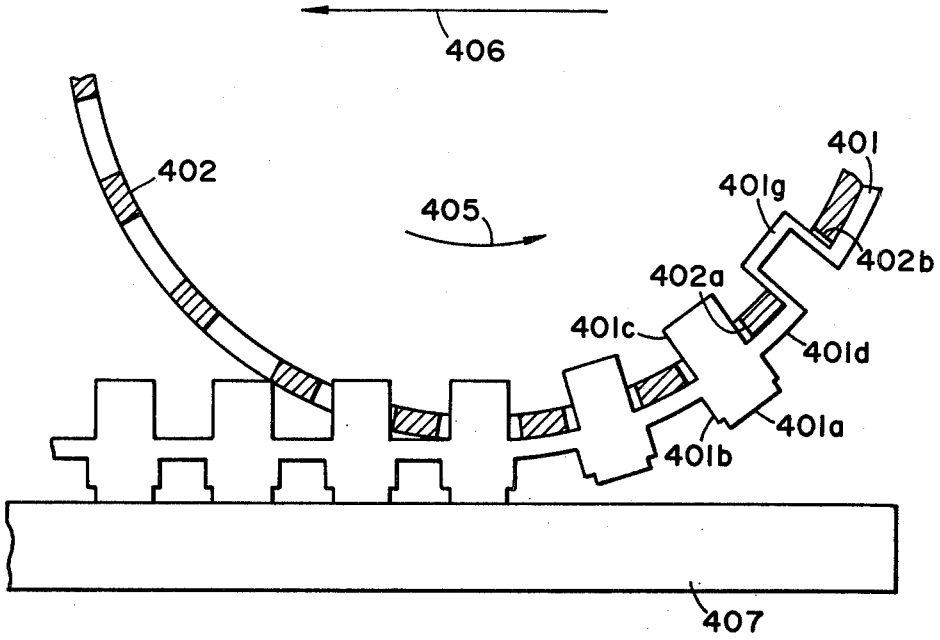
FIG. 11 is a schematic view showing the procedure of assembly of still another embodiment.

FIG. 11 shows the state of fitting the typefont belt 401 of the present invention on the support member 402. The typefont belt 401 is provided with type portions 401*a*, type base portions 401*c* and belt portion 401*d*. A fitting recess portion 401*g* provided on said typefont belt 401 has a larger diameter than other pins 401*c* and firmly engages with the hole 402*b* of the support member when pressed thereinto. Consequently said fitting recess 401*g* does not disengage from the hole 402*b* during the fitting process by rotating the support member in a direction 405 while moving the same in a direction 406 on the typefont belt 401 placed on a table 407, as shown in FIG. 11.

Also the holes 402*a* of the support member 402 and the pins 401*c* of the typefont belt 401 are so mutually shaped that the support member 402 does not collide with the pins 401*c* of the typefont belt 401 when the support member 402 is rolled along the typefont belt 401 as shown in FIG. 11.

In this manner the present embodiment permits improved manufacturing efficiency by means of a simple structure.

Figure 12:
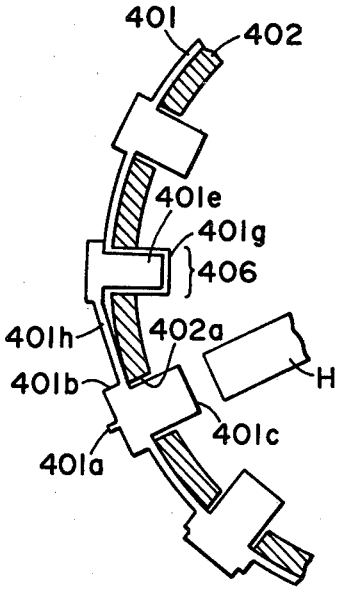
FIG. 12 is a schematic cross-sectional view of the typefont wheel assembled according to the procedure shown in FIG. 11.

FIG. 12 shows the typefont 401 fitted on the support member 402 in the aforementioned manner. This embodiment, however, has the following drawback.

When the bonding recess 401*g* of the typefont belt 401 is bonded with the bonding pin 401*e*, a belt portion 401*h* becomes sloped away from the support member 402 in the direction from the adjacent pin 401*e* to the bonding portion 406. Also the pins 401*c* of the typefont belt 401 are fitted in the holes 402*a* of the support member 402 with a tension in the belt portion between the pins 401*c*. In the printing operation the hammer H strikes the pin 401*c* and returns to the original position by an unrepresented spring, while the type portion 401*a*, type base portion 401*b* and pin 401*c* returns to the original position by said tension in the belt portion. However, in the type portion 401*a*, type base portion 401*b* and pin 401*c* adjacent to the bonding portion 406 having the bonding pin 401*e* and bonding recess 401*g*, the tensions in the belt portions become unbalanced to cause delay in said returning motion or jamming of said pin 401*c* with the hole 402*a*, eventually maintaining the type portion in an unreturned state. In such a case, as the typefont wheel starts rotation after the completion of a printing operation, the type portion 401*a* may rotate in frictional contact with the unrepresented printing sheet, thus significantly deteriorating the print quality.

Figure 13:
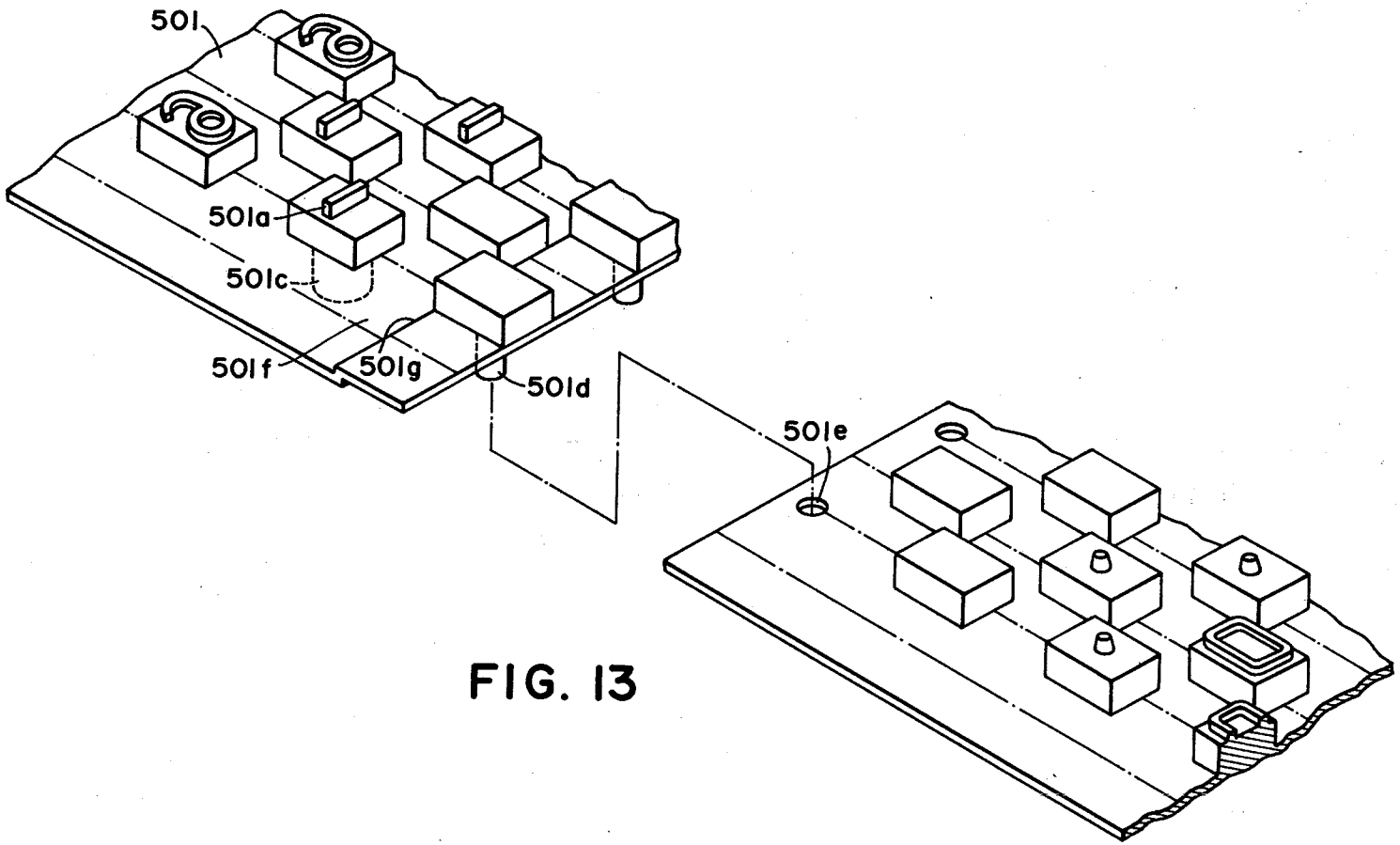
FIG. 13 is a schematic view showing still another embodiment of the typefont belt.
Figure 14:
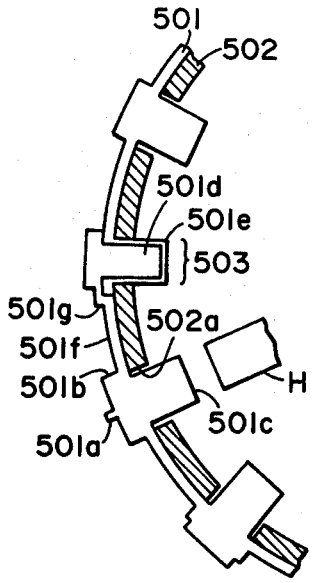
FIG. 14 is a schematic cross-sectional view of the typefont belt shown in FIG. 13 when the belt is fitted around the support member.

Therefore shown in the following is another embodiment capable of improving the print quality. FIG. 13 shows the typefont belt of said embodiment in a perspective view, while FIG. 14 shows said typefont belt fitted around the support member in a cross-sectional view. As shown in FIG. 13, a shoulder 501*g* is formed in the belt between the bonding pins 501*d* and the neighboring pins 501*c*. Due to the presence of said shoulder 501*g*, the typefont belt 501 no longer has a gap to the support member 502 in the belt portion 501*f* between the bonding portion 503 and the adjacent pins 501*c* as shown in FIG. 14, whereby the belt tension between said bonding portion 503 and the adjacent type portion 501*a*, type base 501*b* and pin 501*c* becomes equal to the tension in other parts of the typefont belt.

In this manner the present embodiment ensures satisfactory returning motion of the types with a simple structure thereby providing improved print quality.

Figure 4:
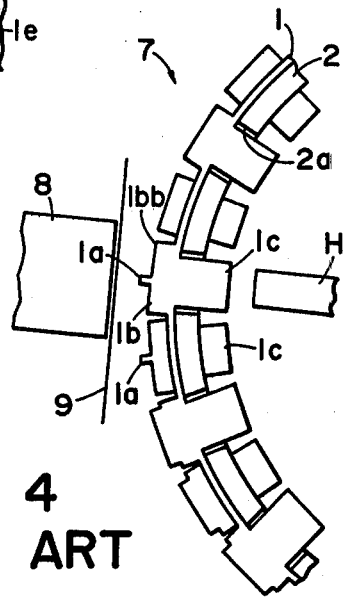
FIG. 4 PRIOR ART
FIG. 4 is a schematic cross-sectional view of a conventional typefont wheel.
Figure 15:
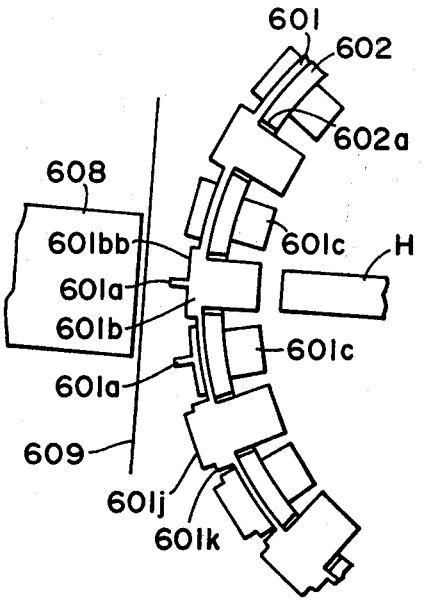
FIG. 15 is a schematic cross-sectional view of still another embodiment of the typefont wheel.
Figure 16:
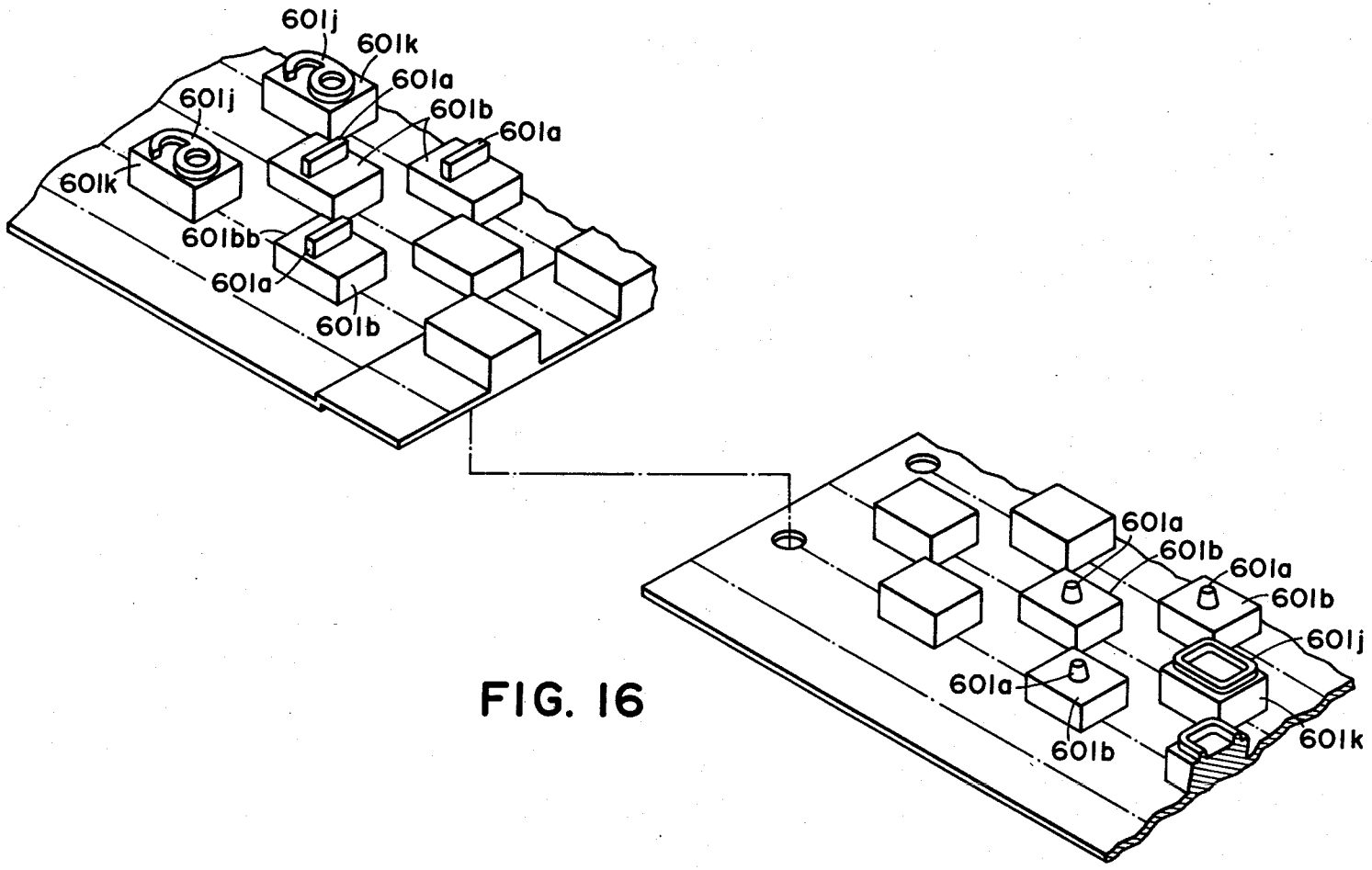
FIG. 16 is a schematic view of the typefont belt employed in the typefont wheel shown in FIG. 15.

The following is still another embodiment for improving the print quality, in which, as shown in FIGS. 15 and 16, a type base 601*b* for a type 601*a* on the typefont belt has a height smaller than that of other type bases 601*k* for ordinary types 601*j* or the type bases 601*b* shown in FIG. 4.

Such a lowered type base is employed for the characters and symbols having smaller type area, to prevent the smear on the printing sheet 609 resulting from contact thereon of the shoulder 601*bb* of the type base. Also such a structure can provide a similar effect on the numerals "1" or "7", or characters "T", "P" or "√". In these figures 602 indicates the support member, 602*a* holes provided thereon and 608 a platen.

Figure 17:
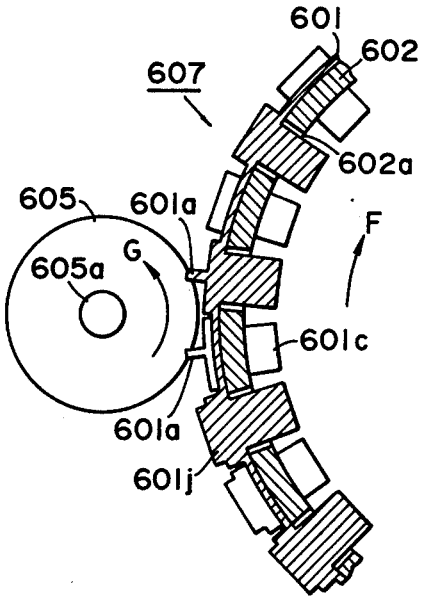
FIG. 17 is a schematic cross-sectional view of the typefont wheel shown in FIG. 15 driving an ink application step.

FIG. 17 illustrates the typefont wheel prepared in the aforementioned manner, which, however, still has the following drawback.

In such a typefont wheel, the printing operation is performed by rotating said typefont wheel 607 with an unrepresented control device and bringing the selected characters or symbols into contact with the printing sheet by an unrepresented hammer positioned inside the support member.

However, during the rotation of said typefont wheel, the ink roller 605 sinks, as shown in FIG. 17, into the gap between the types 601*a* of smaller area such as "-" or "." as shown in FIG. 16, thus braking the rotation.

Such a phenomenon induces a fluctuating load in the rotation of the typefont wheel 607 and causes an undesirable effect on the driving motor.

Figure 18:
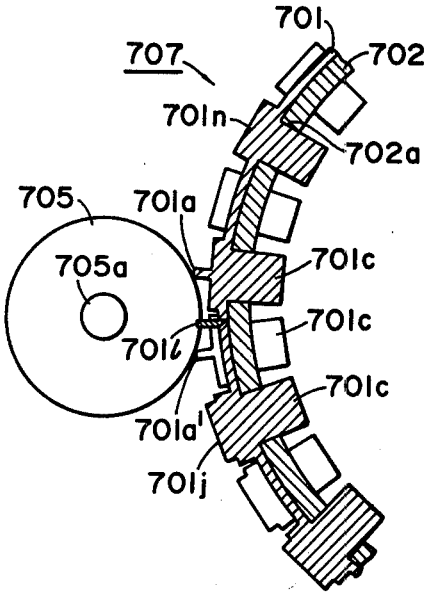
FIG. 18 is a schematic cross-sectional view of still another embodiment of the typefont wheel.
Figure 19:
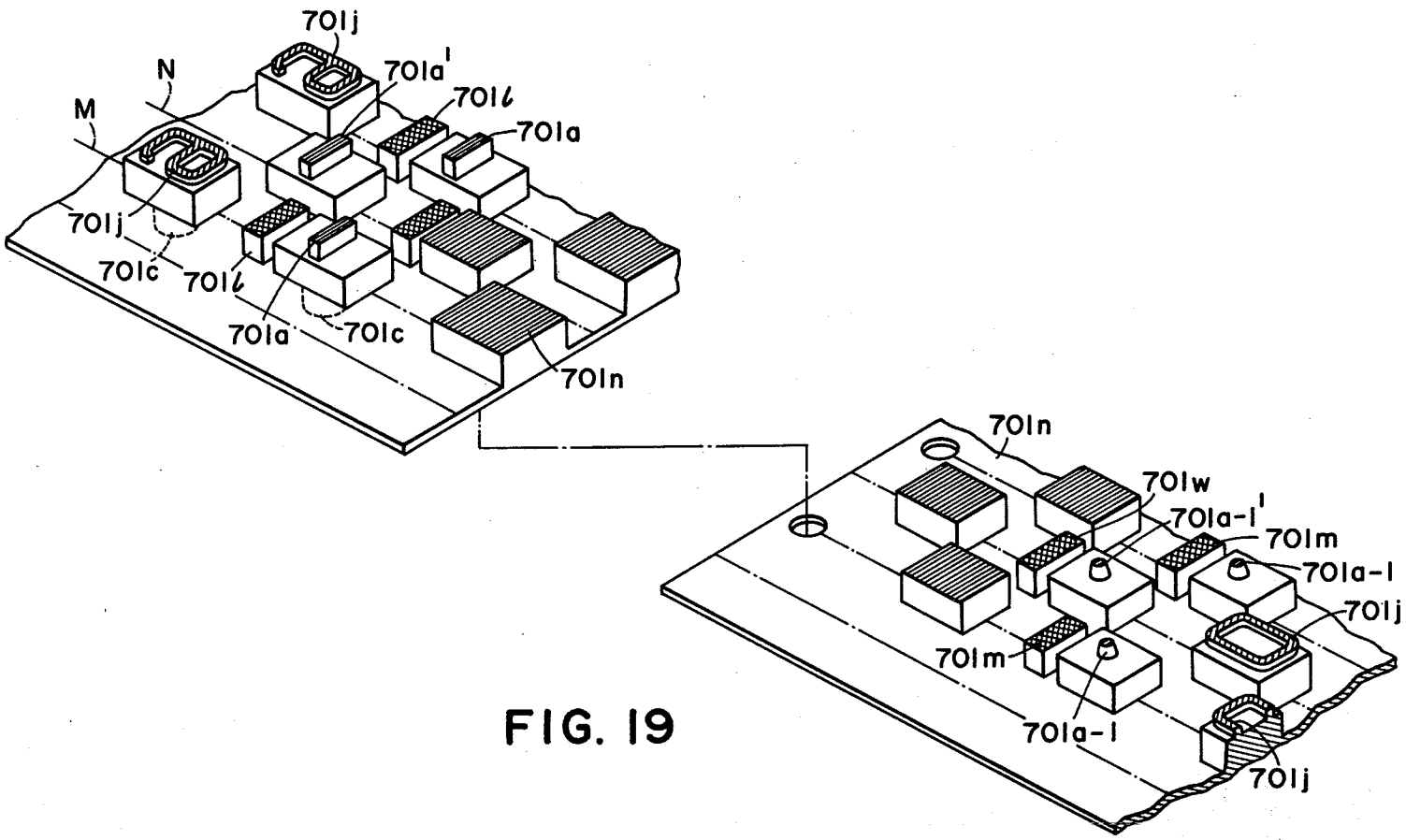
FIG. 19 is a schematic view of the typefont belt employed in the typefont wheel shown in FIG. 18.

Such a drawback can be prevented in the embodiment shown in FIGS. 18 and 19, in which projections 701*l* slightly lower than the types 701*j*, 701*a* are provided for example between a numeral type 701*j* and a symbol type 701*a* for "-" in the row M on the typefont belt 701.

The presence of such a projection avoids the sinking of the ink roller 705 between the types 701*a*, 701*a*' ("-") in the rows M and N and ensures smooth movement of said ink roller along the periphery of the typefont wheel, thus achieving smooth rotation thereof without a braking effect.

Similar projections 701*m* can also be provided between the dot types 701*a*-1, 701*a*-1' (".") for the same effect. 701*n* indicates dummy types, and 702 indicates the support member.

The following is still another embodiment capable of improving the print quality.

Figure 1:
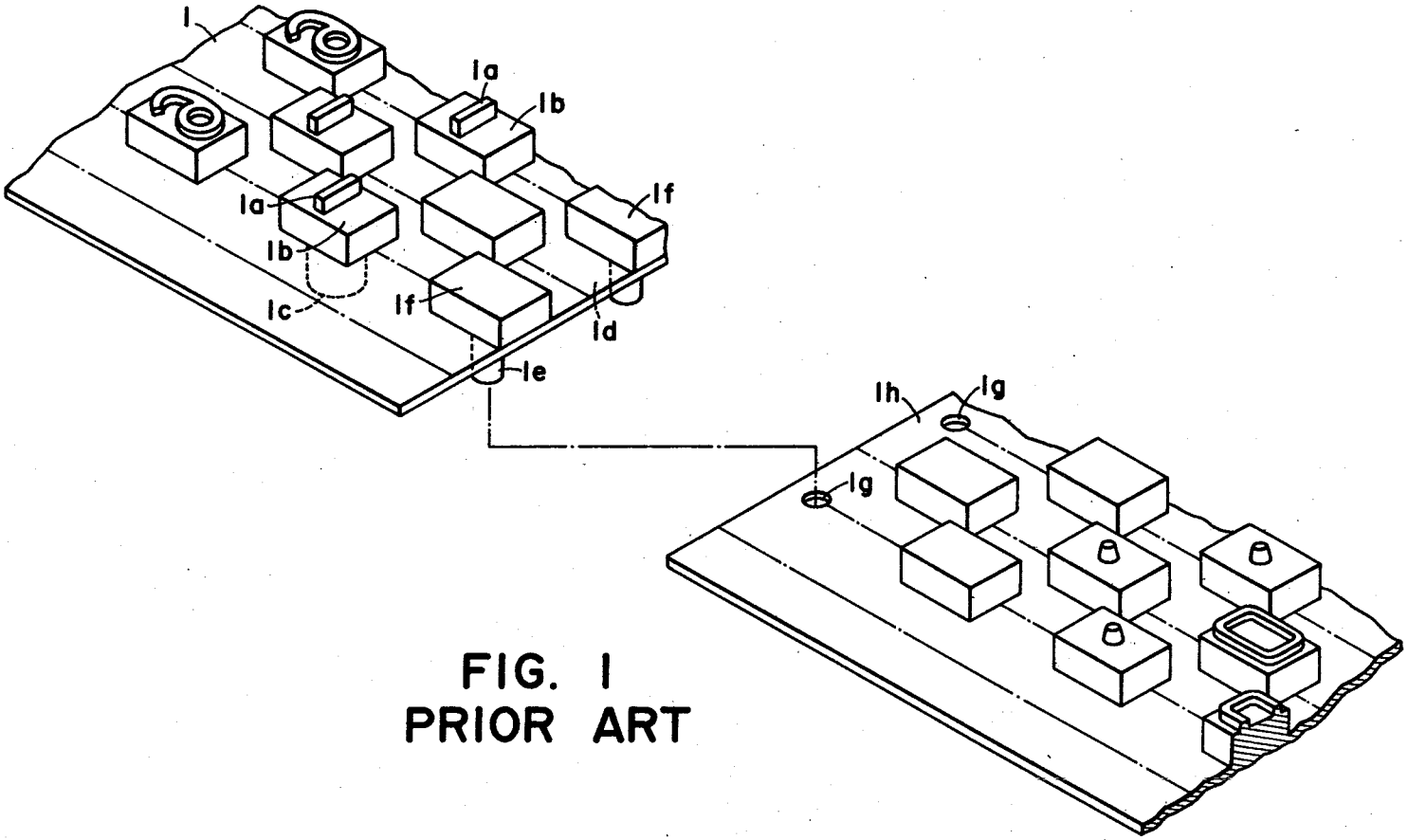
FIG. 1 PRIOR ART
FIG. 1 is a schematic view of a conventional typefont belt.
Figure 2:
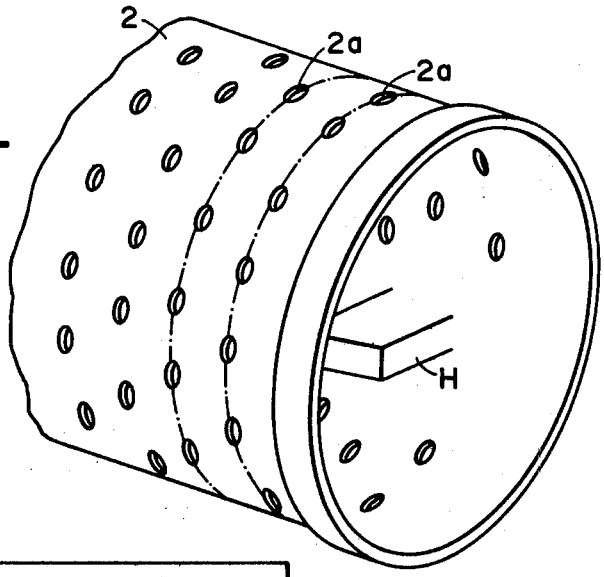
FIG. 2 PRIOR ART
FIG. 2 is a schematic view of a support member for such typefont belt.
Figure 3:
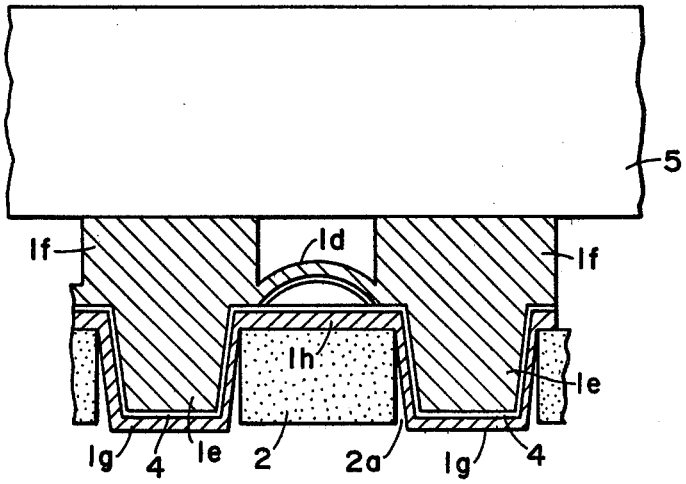
FIG. 3 PRIOR ART
FIG. 3 is a schematic view of the bonding portion of a conventional typefont belt.
Figure 20:
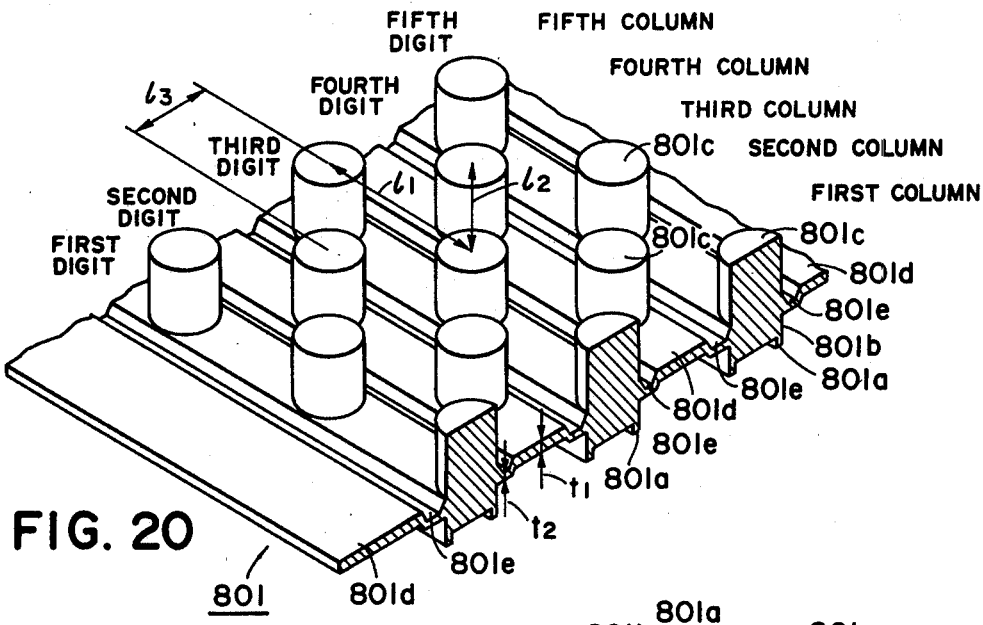
FIG. 20 is a schematic view of still another embodiment of the typefont belt.

In this embodiment, as shown in FIG. 20, the typefont belt 801 is integrally molded and is provided, on the top face thereof, with type portions 801*a* in checkerboard arrangement and type bases 801*b* positioned thereunder, and, on the bottom face thereof, with corresponding pins 801*c* to be fitted in a plurality of holes 2*a* in the support member 2 shown in FIG. 2. As explained in the foregoing, the pitch of said holes 2*a* is selected larger than that of said pins 801*c*, so that the typefont belt 801 is fitted with a tension along the periphery. A hammer H is provided inside the support member 2 shown in FIG. 2, and an unrepresented ink roller applies ink to the types 801*a* on said typefont belt 801. Also a printing sheet and a platen are positioned in facing relationship to said types 801*a* of the typefont belt 801. In such a structure, the printing operation is performed by rotating the typefont wheel with an unrepresented motor to a position where a selected pin 801*c* faces the hammer H, and by striking said pin 801*c* with the hammer H to bring the corresponding type 801*a* in contact with the printing sheet. The checkerboard arrangement of the types 801*a* facilitates the movement of each type with limited stress.

Figure 21:
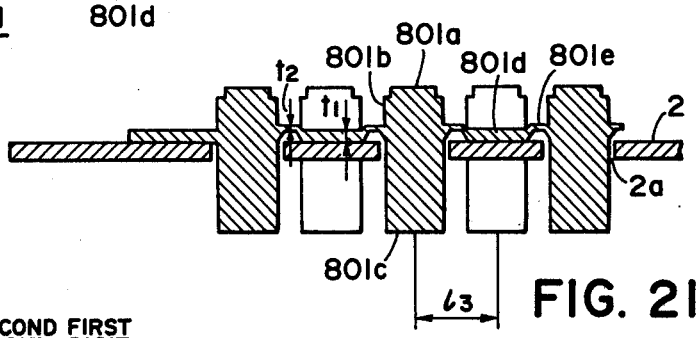
FIG. 21 is a schematic cross-sectional view of the typefont belt shown in FIG. 20 in a state fitted around the support member.

FIG. 21 shows the cross section of the typefont belt shown in FIG. 20, wherein the type 801*a*, type base 801*b* and pin 801*c* are formed in plural units on a flat strip portion 801*d* of a determined thickness t1. There are also provided bridge portions 801*e* of a thickness t2 small than t1 for connecting the type base portions 801*b* of the typefont belt 801.

Figure 22:
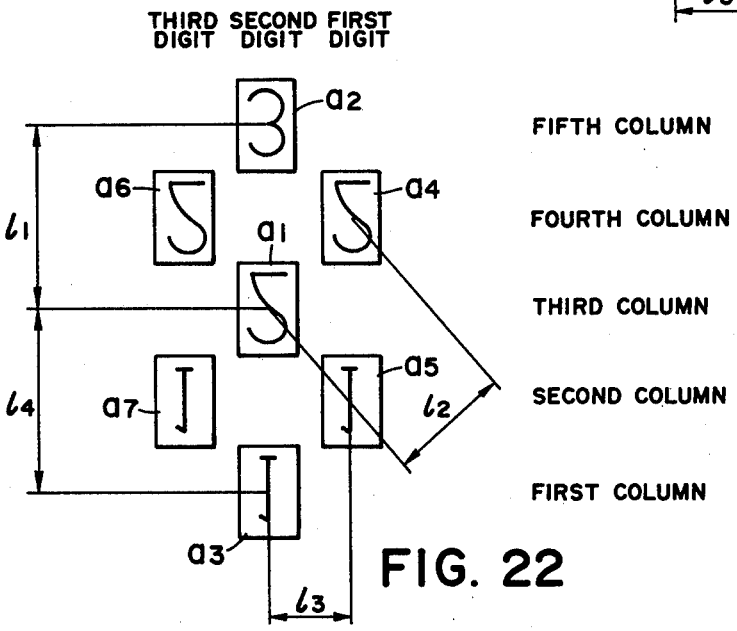
FIG. 22 is a schematic view showing the function of the typefont wheel shown in FIG. 21.

The function of the present embodiment will be explained in relation to FIG. 22. A motion for lifting, for example the type a1, also slightly lifts the longitudinally neighboring types a2 and a3, and further tends to lift the surrounding types a4, a5, a6 and a7. In case the connecting belt has a uniform thickness t1, the force F1 required for lifting the types a2 and a3 is smaller than the force F2 required for lifting the types a4, a5, a6 and a7 because of the longer distance l1 between the types a1 and a2 than the distance l2 between the types a1 and a4.

Consequently a larger force is lost in the direction of l2 than in the direction of l1 if the belt is provided with a uniform thickness t1. Since the distance l3 is given, the loss in the direction of l2 should be minimized in order to reduce the energy required for printing. This object is achieved in the present embodiment by providing thinner bridge portions of a smaller thickness t2 in the lateral direction.

The thicker portion 801*d* along the direction of l1 or l4 is effective for reducing the vibration of the type when it is struck.

As explained in the foregoing, the present embodiment is effective in reducing the printing energy by means of a simple structure.

In the foregoing embodiments, the components represented by a same name have substantially same function even though they are represented by different numbers.

What we claim is:

1. A typefont wheel, comprising:

a cylindrical support member having plural through-holes on the periphery thereof and being provided with a hammer therein; and a typefont belt being fitted around said support member and having one end portion with a plurality of holes and having another end portion with, on the top face of said belt, a plurality of projections which are fitted into said plurality of holes, said belt including:

groups of typefonts arranged on the top face in a predetermined order;

first pin portions protruding from the bottom face of said belt at positions corresponding to positions where said groups of typefonts are provided on the top face so that said first pin portions fit into through-holes; and second pin portions protruding from the bottom face at positions corresponding to positions where said projections are provided on the top face so that said second pin portions fit with said through-holes, said second pin portions being formed lower than said first pin portions to prevent striking hereof by the hammer.

2. The typefont wheel according to claim 1, wherein said plurality of holes provided on the one end portion of said belt are arranged in a staggered arrangement and said projections provided along the other end portion of said belt are also arranged in a staggered arrangement so as to fit into said holes.

3. A type wheel, comprising a support member and a typefont belt being fitted therearound, said typefont belt including:

typefonts arranged on the top face of said typefont belt;

second fitting portions provided on the bottom face along one end portion of said belt;

second fitting portions provided on the bottom surface along the other end portion of said belt, and being shaped to fit with said first fitting portions;

a bonding layer provided between said first and second fitting portions for bonding them together; and a protruding portion protruding from the position of the top face of said belt and corresponding to said first fitting portion, said protruding portion having a uniform height and having a width larger than that of said typefonts.

4. A typefont wheel according to the claim 3, wherein said protruding portion has a height smaller than that of said typefonts.

5. A typefont wheel, comprising:

a typefont belt having type portions on the top face thereof and having pins protruding on the bottom face thereof positioned to correspond to the positions of said type portions; and a cylindrical support member adapted to fit therearound said typefont belt, said support member being provided with through-holes for engaging said pins of the typefont belt and having a hammer therein, said through-holes of said cylindrical support member being formed substantially parallel with one another.

6. A typefont wheel according to the claim 5, wherein said through-hole of the support member have different diameters.

7. A typefont wheel, comprising:

a support member having a peripheral surface with a plurality of holes therein; and a sheet-type typefont belt being fitted around said support member, and including:

pins protruding from said belt for engaging said plurality of holes of said support member and having an end portion whereat recessed portions protrude from the bottom face thereof, said recess portions of a size to be pressed into the holes of said support member to engage said belt to said support member.

8. A typefont wheel according to claim 7, wherein said recessed portions are sized so as to engage said protruding pins.

9. A typefont wheel, comprising:

a cylindrical support member being provided with a hammer therein; and a typefont belt being fitted around said support member, and including:

first type bases protruding from said belt and supporting printing types thereon; and second type bases being smaller in height than said first type bases protruding from said belt and supporting printing types thereon.

10. A typefont wheel according to the claim 9, wherein the printing types on said second type bases have a smaller area than those on said first type bases.

11. A typefont wheel, comprising:

a cylindrical support member provided with a hammer therein; and a typefont belt fitted around said support member, said belt including a plurality of strip portions each having a plurality of typefonts arranged in the circumferential direction of said support member, and a plurality of film portions thinner than said plurality of strip portions, each of said film portions being arranged between said strip portions, said strip portions and said film portions being integrally formed.

* * * * *

UNITED STATES PATENT AND TRADEMARK OFFICE

CERTIFICATE OF CORRECTION

PATENT NO. : 4,457,230

DATED : July 3, 1984

INVENTOR(S) : HITOSHI KURIHARA, ET AL.

It is certified that error appears in the above-identified patent and that said Letters Patent is hereby corrected as shown below:

Column 1, line 15, after "belt" insert --made,--;

line 16, after "member" insert a comma;

line 17, after "member" delete comma;

line 53, change "edge" to --edges--;

line 65, before "time" insert --long--.

Column 3, line 30, change "driving" to --during--;

line 47, change "principle" to --principal--.

Column 4, line 9, change "stripes" to --strips--;

line 16, after "Thus" insert a comma;

lines 50 and 51, delete "as" and "illustrated";

line 62, change "this" to --there--.

line 68, after "view" insert a comma and after "and" delete the comma.

Column 6, line 38, after "302d" insert a comma.

UNITED STATES PATENT AND TRADEMARK OFFICE

CERTIFICATE OF CORRECTION

PATENT NO. : 4,457,230

DATED : July 3, 1984

INVENTOR(S) : HITOSHI KURIHARA, ET AL.

It is certified that error appears in the above-identified patent and that said Letters Patent is hereby corrected as shown below:

Column 7, line 59, delete the comma.

Column 10, line 22, change "through-hole" to --through-holes--.

Signed and Sealed this

*Ninth* Day of *April 1985*

[SEAL]

*Attest:*

DONALD J. QUIGG

*Attesting Officer* *Acting Commissioner of Patents and Trademarks*